United States Patent [19]

Neugebauer et al.

[11] Patent Number: 4,942,971

[45] Date of Patent: Jul. 24, 1990

[54] CONTAINER

[75] Inventors: Peter Neugebauer, Barmstedt; Helmut Meyer, Halstenbek, both of Fed. Rep. of Germany

[73] Assignee: Drehtainer Consulting GmbH, Hamburg, Fed. Rep. of Germany

[21] Appl. No.: 188,806

[22] Filed: May 2, 1988

[30] Foreign Application Priority Data

Oct. 10, 1987 [DE] Fed. Rep. of Germany ..... 3734357
Jan. 7, 1988 [DE] Fed. Rep. of Germany ..... 3800205

[51] Int. Cl.[5] ..... B65D 90/58

[52] U.S. Cl. ..... 220/1.5; 220/6; 220/346

[58] Field of Search ..... 105/377; 220/1.5, 4 F, 220/6, 345, 346, 378; 296/100

[56] References Cited

U.S. PATENT DOCUMENTS

| | | | |
|---|---|---|---|
| 1,994,399 | 3/1935 | Moreau | 220/1.5 |
| 3,408,958 | 11/1968 | Plasch | 105/377 |
| 3,514,005 | 5/1970 | Irwin | 220/1.5 |
| 3,520,257 | 7/1970 | James | 105/377 |
| 3,540,771 | 11/1970 | Stoneburner | 105/377 |
| 3,784,054 | 1/1974 | Mautz | 220/1.5 |
| 4,009,796 | 3/1977 | Schmidt | 220/345 |
| 4,390,217 | 6/1983 | Wagner | 220/345 |
| 4,569,293 | 2/1986 | Kramer et al. | 105/377 |

FOREIGN PATENT DOCUMENTS

| | | |
|---|---|---|
| 1168332 | 4/1964 | Fed. Rep. of Germany . |
| 3320380 | 12/1984 | Fed. Rep. of Germany . |
| 1112529 | 3/1956 | France . |
| 0406573 | 3/1934 | United Kingdom . |
| 0946466 | 1/1964 | United Kingdom . |

*Primary Examiner*—Jimmy G. Foster
*Attorney, Agent, or Firm*—Ladas & Parry

[57] ABSTRACT

Disclosed herein is a container having a base plate with a longitudinal axis, two end walls extending generally perpendicularly of said base plate, and a hood extending from and above said base plate and between said end walls. The hood is comprised of at least one rigid piece and is displaceable along the longitudinal axis of the base plate. At least one of the end walls is secured permanently to the hood and releasably secured to the base plate.

38 Claims, 15 Drawing Sheets

CONTAINER

DESCRIPTION

Figure 1:
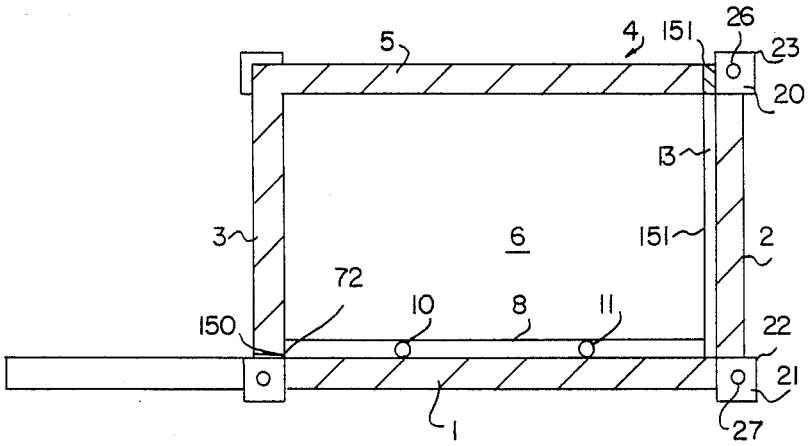

The invention covers a container having a base plate, two end walls and a hood guided at said base plate.

Boxes for the transport of merchandise are usually constructed as containers which have openings at one of their end walls, closed by doors to permit access to the inner space of said container. Due to this structure of the containers, it is quite difficult to take out merchandise stowed inside the container near the end opposite to the door before unloading the merchandise which is stowed near said door. If large, heavy merchandise is stowed inside the container, it is even impossible to reach goods stowed on the side opposite the door. The fact that it is often impossible to have access to the rear area of the container requires complicated planning at considerable cost when merchandise is to be carried to several different destinations. Besides, this construction of the container excludes optimal utilization of the stowage capacity of said container when multiple places of lading and multiple destinations are involved, since care must always be taken to unload first the merchandise which has been loaded last.

To begin solving these problems, containers became known which have stationary walls but detachable roofs. The use of similar containers, however, is possible only where there are suitable cranes to lift off the roof. In addition, it is necessary to load and unload from above with cranes or conveyor bridges, since there is no lateral access to the rear areas of the stowage space. We also know of containers which have doors in their lateral walls, respectively openings closed with tarps. The use of such containers, however, leads to considerable sealing problems and there is no adequate safety against theft of merchandise stowed inside of the container. Container have also been used for special applications which have stationary lateral walls connected with tarpaulings at their vertical upper edges which close the stowage space surrounded by said lateral walls in a vertical direction from above. These kinds of containers also face considerable sealing problems. In addition, the risk of theft of merchandise stowed in the container is even higher than in the containers which have tarps in their lateral walls, because damage to the tarps in the roof area is noticed only during a thorough inspection of the containers, respectively when loading or unloading operations are in course.

We further know of containers which consist essentially of a bottom part and a hood. The bottom part has a base plate and end walls rigidly connected with the latter. The hood consists of two partial elements, each extending in the longitudinal direction of the containers. They are expandably connected with each other. With a combination of lifting and expanding movements, the cover is lifted up over the end walls and carried past the latter. Accurate mechanical guidance of the individual parts is required for the lifting and expanding movements which increases the manufacturing cost of the containers. This expense precludes the widespread application of similar containers, since only in special cases can the practical requirements justify the expenses incurred in the manufacture and operation of these containers.

It is therefore the task of the present invention to so improve a container of the above-described kind, that any desired part of the inner space of said container can be loaded or unloaded simply and independently from other merchandise stowed inside.

This problem is solved by the invention by providing a rigid hood so mounted that it can be positioned in relation to the base plate.

The design of the hood as a rigid part makes the manufacture of the containers economical and ensures low maintenance during operation. This particularly eliminates the costly expanding mechanisms which require frequent maintenance of the container. Due to the displaceability of the hood in relation to the base plate, any part of the inner container is laid open and becomes freely accessible. It is now possible to load and unload the constainer in a vertical direction from above. It is also possible to unload the container from the sides by means of a fork lift without using a ramp. The free access from above in a vertical direction ensures rapid loading and unloading with the aid of cranes or conveyor bridges. The hood can be displaced with a small effort, since little hoisting is required.

According to one preferred embodiment of the invention, the transport box is made as a container which has at least one end wall, swivel-mounted on the base plate. Due to the arrangement of guide devices which guide the hood at the tiltable end wall, it is possible to guide the hood in a simple way over a large part of its displacement. An expansion of this area of secure guidance prevents the hood from tilting against the guides provided at the base plate and thus ensures a smooth movement of the hood over its entire slide path.

According to another preferred embodiment of the invention, the hood is subdivided into at least two partial hoods mounted one after the other in the longitudinal axis of said container. The division of the hood into partial hoods increases its flexibility during loading and unloading of the container. If, for instance, one part of a hood divided into two parts, is moved into the area of an end wall tilted on the base plate, suitable positioning of the second partial hood will give access to the part of the inner container which is at that time being loaded or unloaded. Another advantage of the subdivision of the hood into two partial hoods consists of the fact that during displacement of a partial hood only the weight of this particular part of the overall hood must be moved. The subdivision of the hood into partial hoods thus makes it possible to simply move said partial hoods manually without recourse to special mechanical drives.

According to another preferred embodiment of the invention, at least one of the two end walls is permanently connected with the hood and can be released from the base plate. This way, the two lateral walls and the roof of the hood are connected in a stable form so that the entire hood has a high twisting strength. If both end walls are firmly connected with the respective parts of the hood, there will be relatively short cylinder-like parts at each end wall, the twisting strength of which is guaranteed by their shape.

It is recommended to also design the corner posts tiltable and to connect the end walls permanently to the hood, while they can be released from the base plate. This way, the corner posts could also be tilted when the hood is to be displaced in relation to the base plate. For this purpose, the corner posts could be designed to serve as guides for the hood.

In a non-tilted position, the corner posts of another preferred embodiment of this invention are integrated into the stationary end wall. This way, the container does not exceed standard dimensions and still has the usual capacity.

Other features of the invention result from the detailed description hereafter and the enclosed drawings in which preferred embodiments of the invention are given as examples:

The drawings show:

FIG. 1: A section through a container along line I—I, in FIG. 2.

Figure 2:
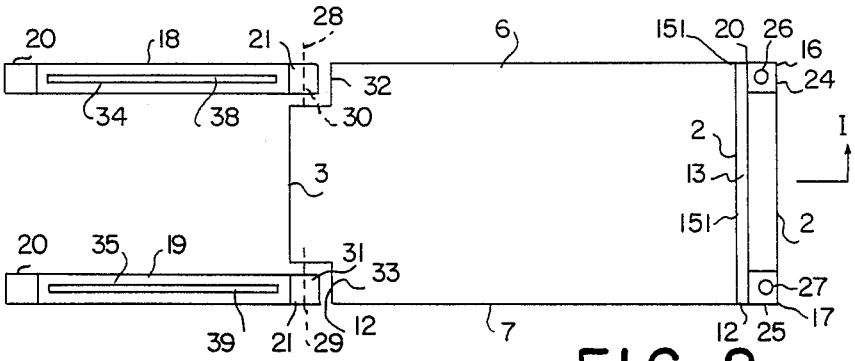

FIG. 2: A top view of the container according to FIG. 1.

Figure 3:
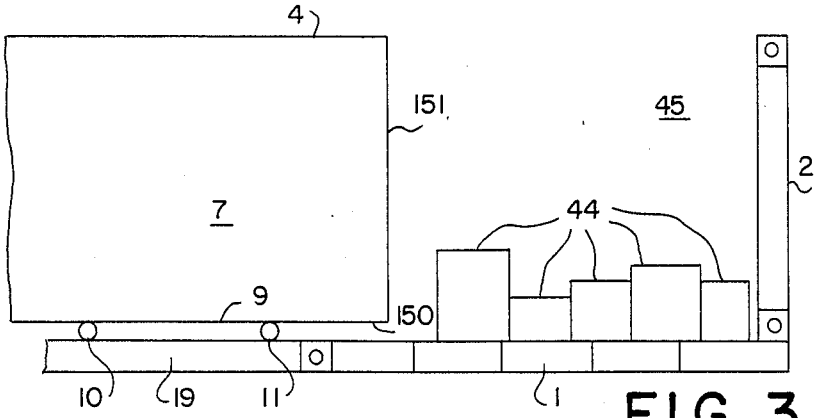

FIG. 3: A lateral view of a container the cover of which has been moved from the basic position.

Figure 4:
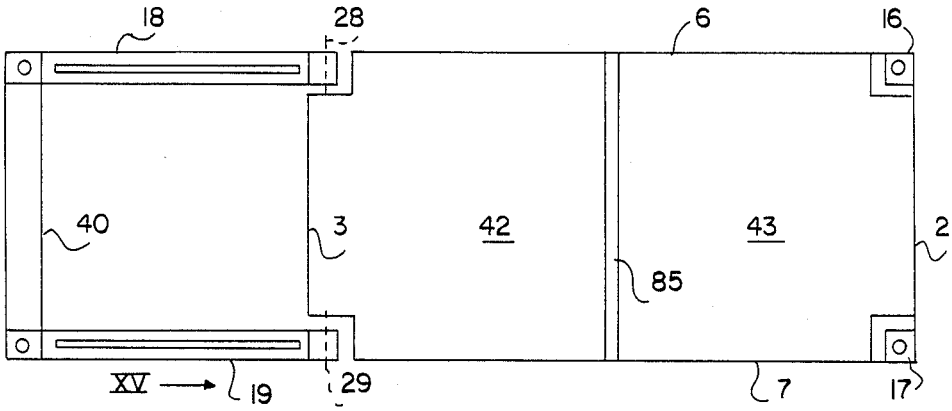

FIG. 4: A top view of a container with a divided hood.

Figure 5:
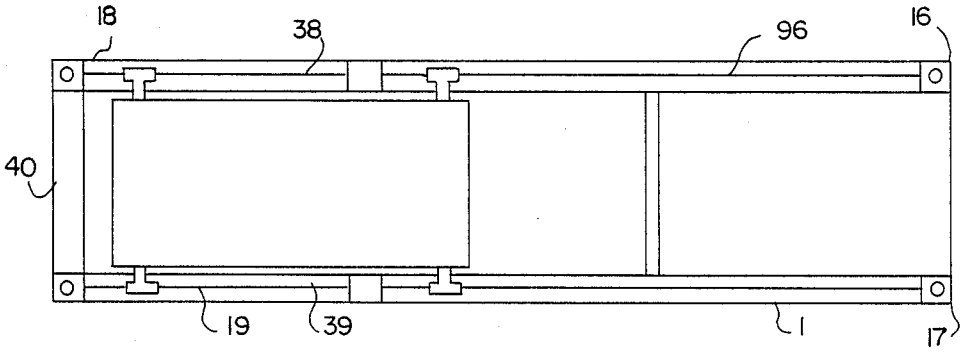

FIG. 5: A top view of a container with a hood extending between the corner posts.

Figure 6:
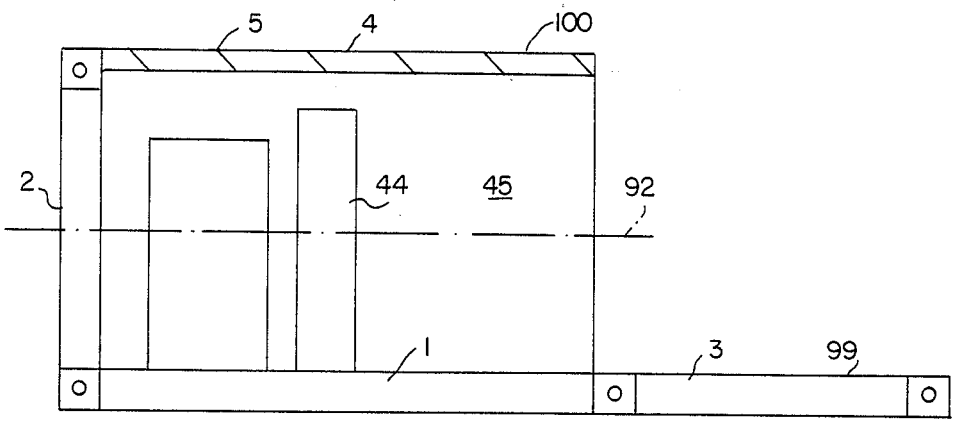

FIG. 6: A longitudinal section through a container with an end wall tiltable in relation to the base plate.

Figure 7:
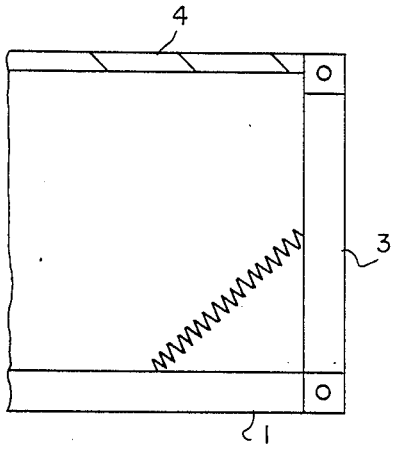

FIG. 7: A partial view of a longitudinal section of a container with an end wall spring-rigged in relation to the base plate.

Figure 8:
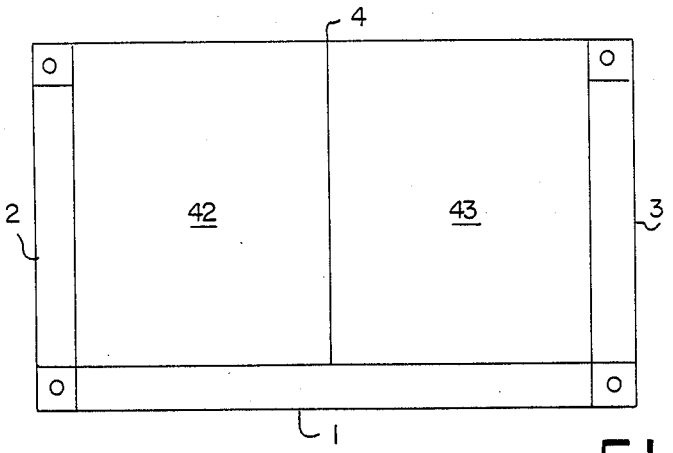

FIG. 8: A lateral view of a container with a divided hood.

Figure 9:
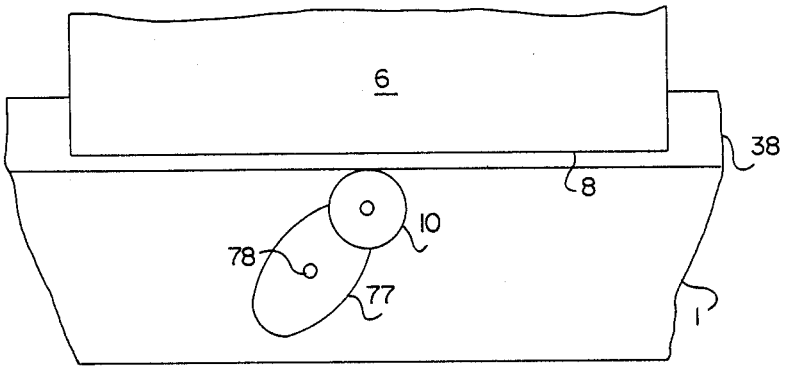

FIG. 9: An enlarged view of an eccentric roller guide for the hood.

Figure 10:
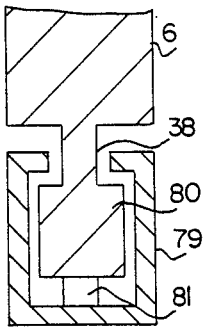

FIG. 10: A partial view of a cross section through a hood guided on rails.

Figure 11:
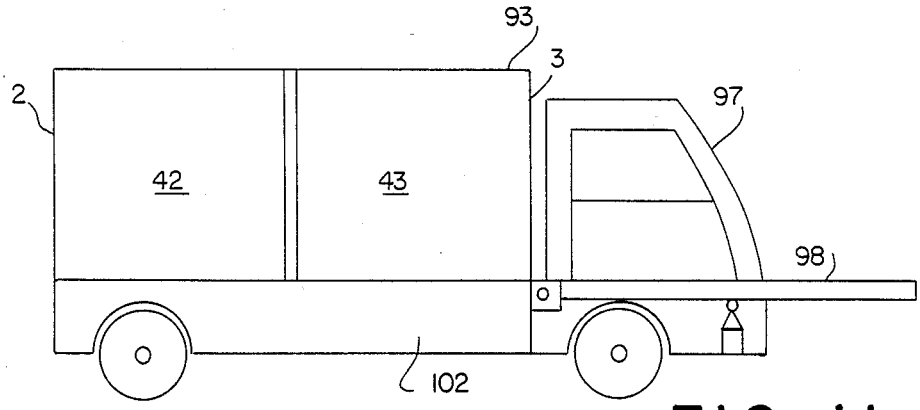
Figure 12:
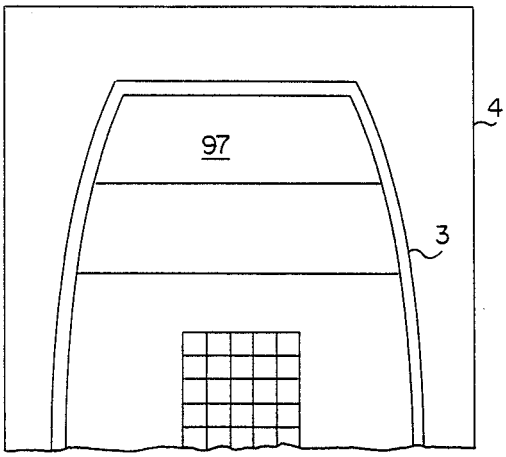

FIG. 11: Lateral view of a container designed as part of a truck with a guide rail mounted at the operator's cabin of the truck;

FIG. 12: Front view of a container which forms part of a truck with a conical hood supported at an end wall.

Figure 13:
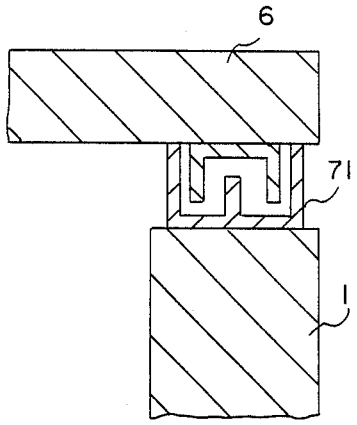
Figure 14:
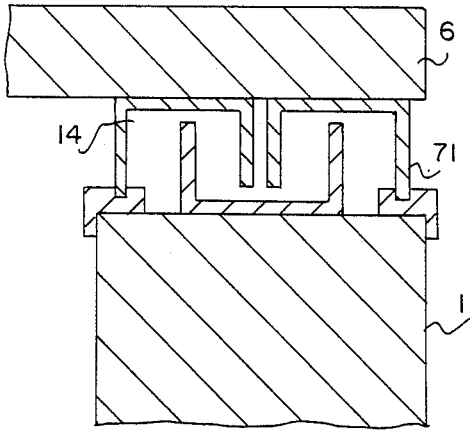

FIG. 13: Partial view of a labyrinth packing installed between the hood and the end wall;

FIG. 14: View of another labyrinth packing.

Figure 15:
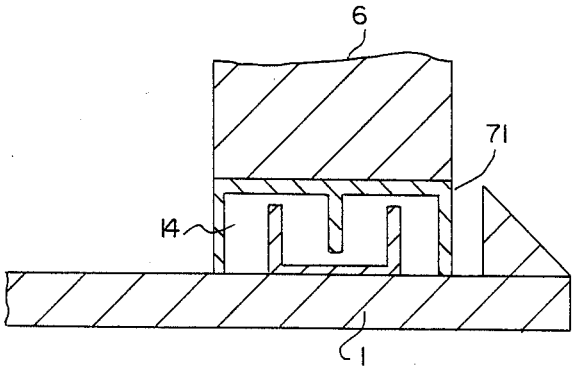

FIG. 15: View of another labyrinth packing with additional, essentially triangular deflector.

Figure 16:
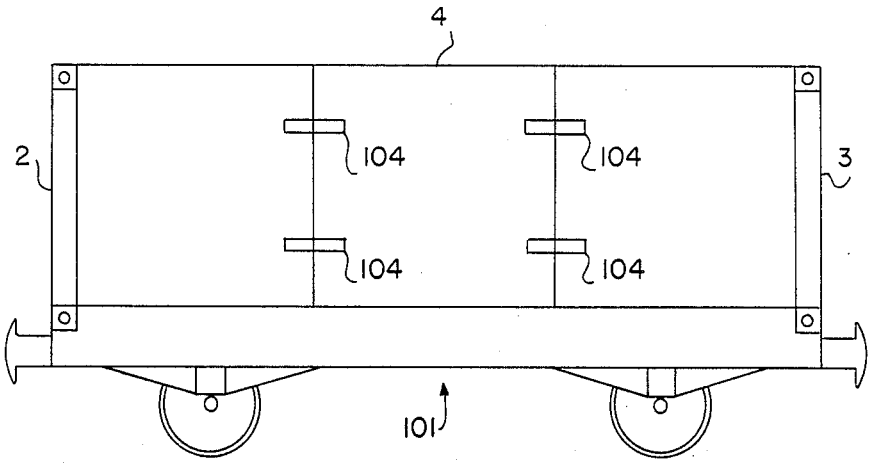

FIG. 16: Lateral view of a container designed as a railroad wagon.

Figure 17:
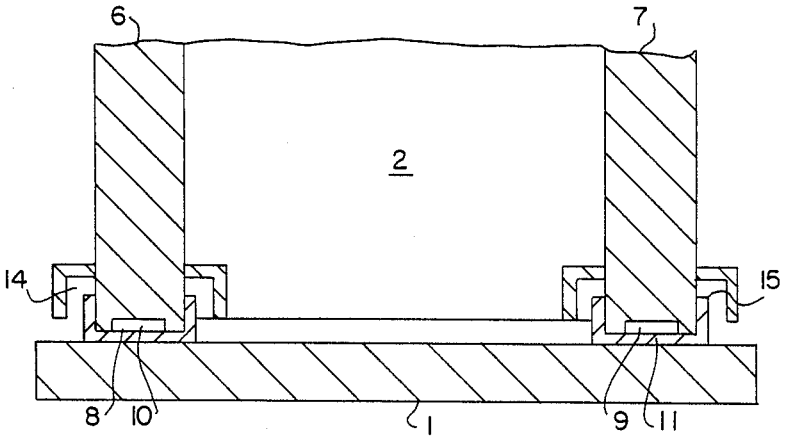

FIG. 17: Partial view of a cross section of a hood guided at an end wall, tilted in relation to the base plate.

Figure 18:
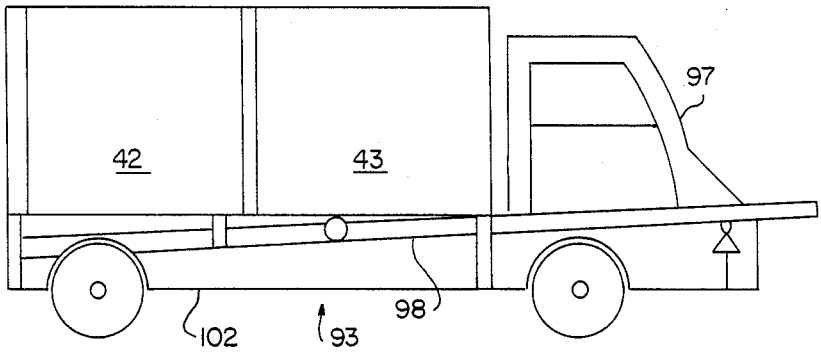

FIG. 18: Lateral view of a container designed as part of a truck with tiltable guide rail mounted at the rear end of the truck.

Figure 19:
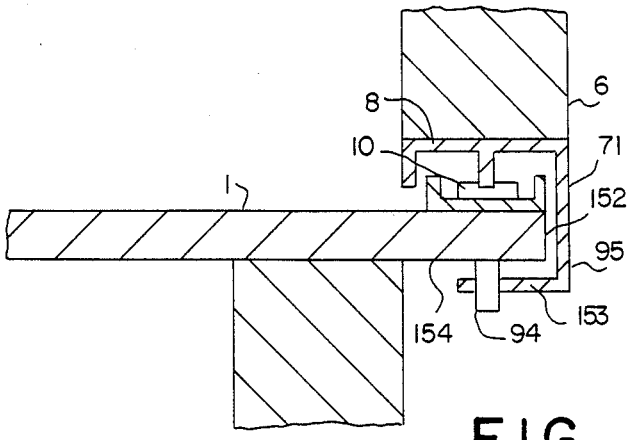

FIG. 19: Partial view of a container whose cover has roller guides running in a vertical direction above and below the base plate.

Figure 20:
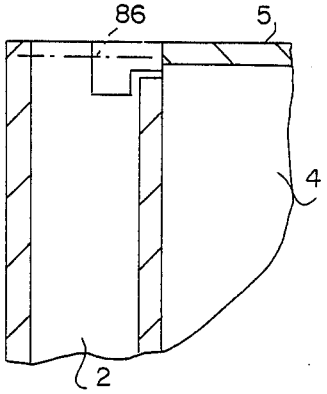

FIG. 20: Partial view of a longitudinal section of a container in the area of a corner post of an end wall which has a bolt by means of which the connection between hood and corner post can be released.

Figure 21:
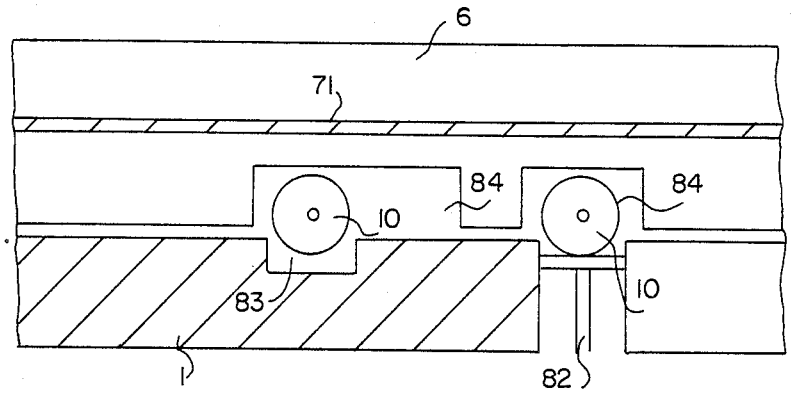

FIG. 21: Partial view in longitudinal section of a container with a pair of rollers mounted in recesses and a hoisting device to lift the hood in a vertical direction.

Figure 22:
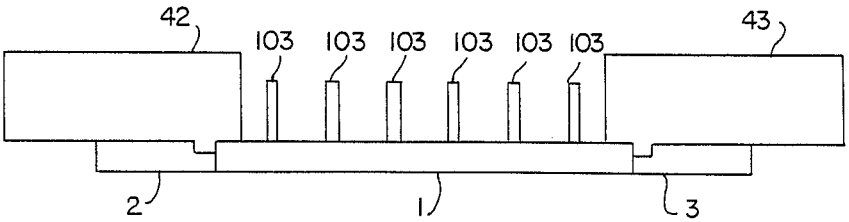

FIG. 22: Lateral view of a container with a divided hood displaced sideways so as to give access to the loading space.

Figure 23:
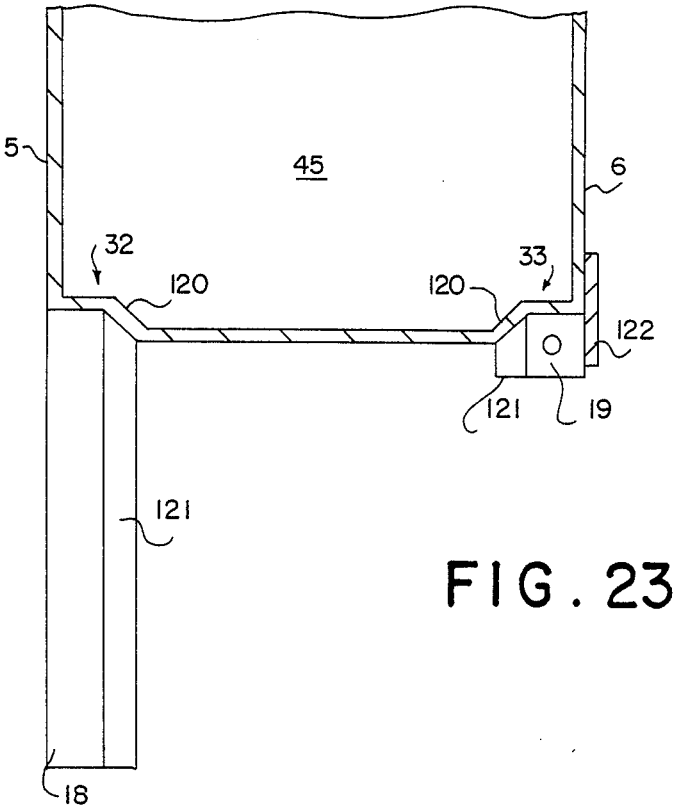

FIG. 23: Horizontal section through a partial view of a container with tiltable corner posts, each of the latter having a guide profile fitting into a guide recess.

Figure 24:
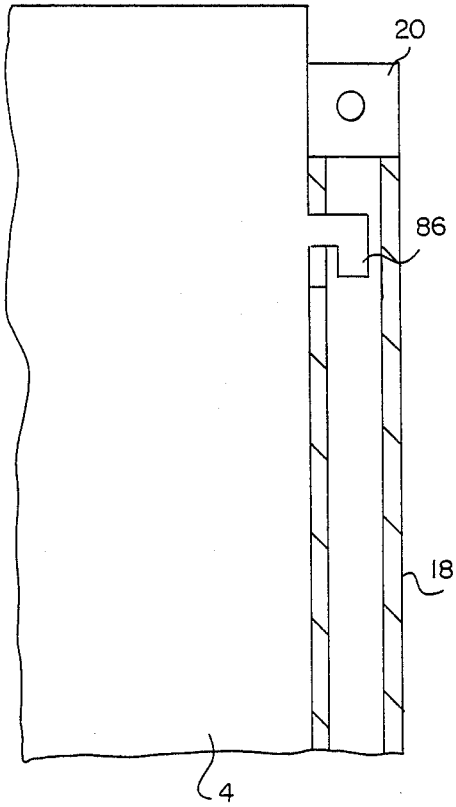

FIG. 24: Partial view of a vertical section through a corner post having an opening which receives a locking mechanism connected to the hood.

Figure 25:
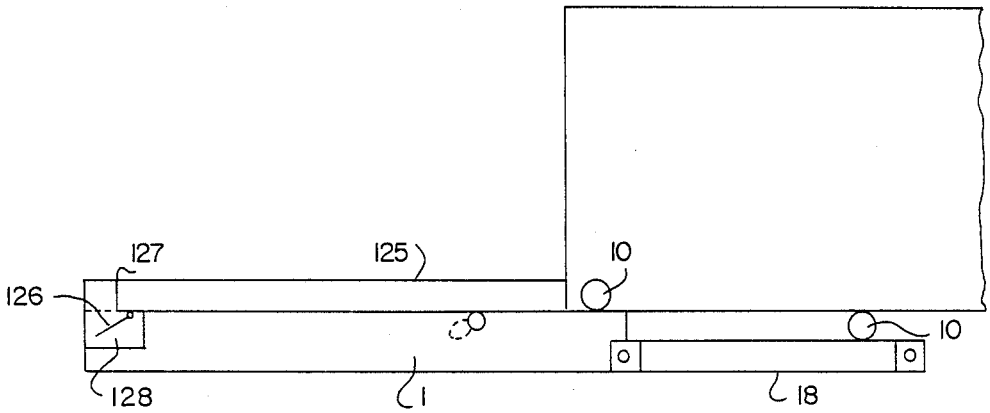

FIG. 25: Lateral view of a container with tilted corner post which at its base plate is equipped with a longitudinal bar and a flap arresting the rollers of the hood in the basic position.

Figure 26:
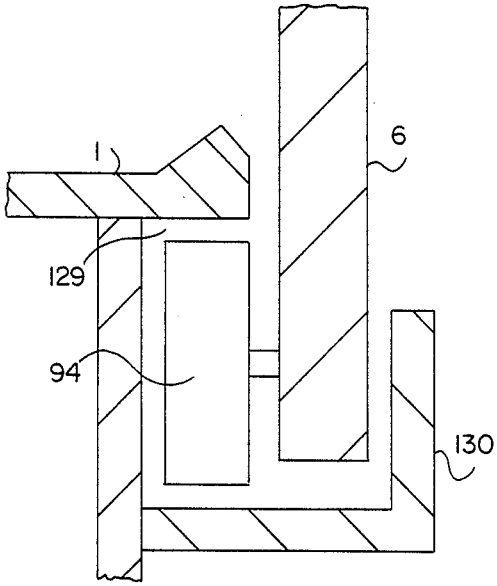

FIG. 26: Cross section through a rail guiding the rollers in a vertical direction below the base plate.

Figure 27:
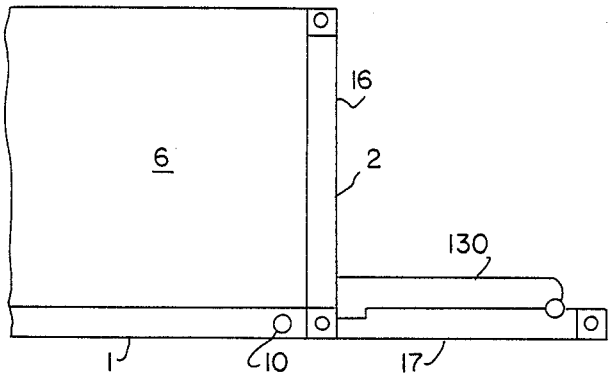

FIG. 27: Lateral view of a container with tilted corner posts and a longitudinal bar mounted at the corner post.

Figure 28:
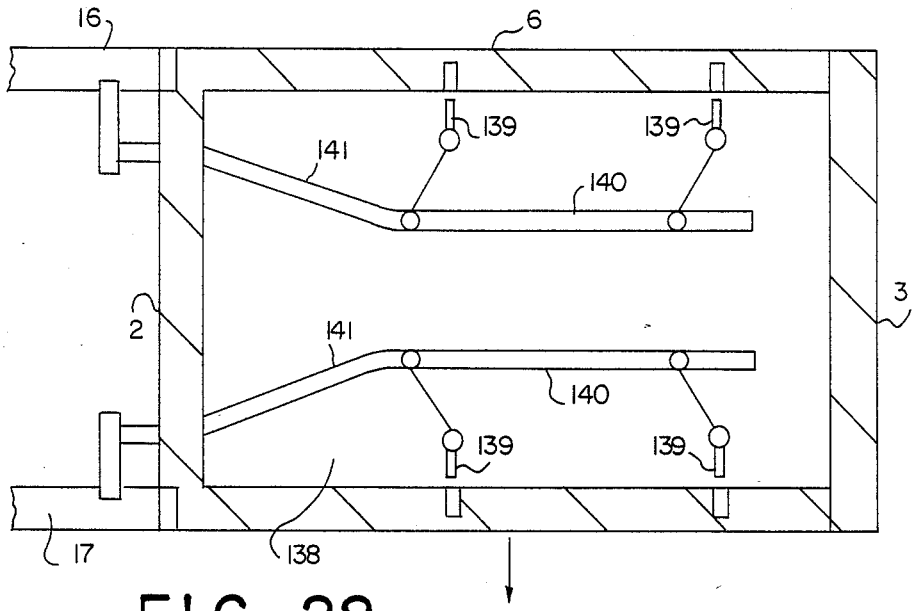

FIG. 28: Horizontal section through a container with a locking device having a central linkage connected with operating elements.

Figure 29:
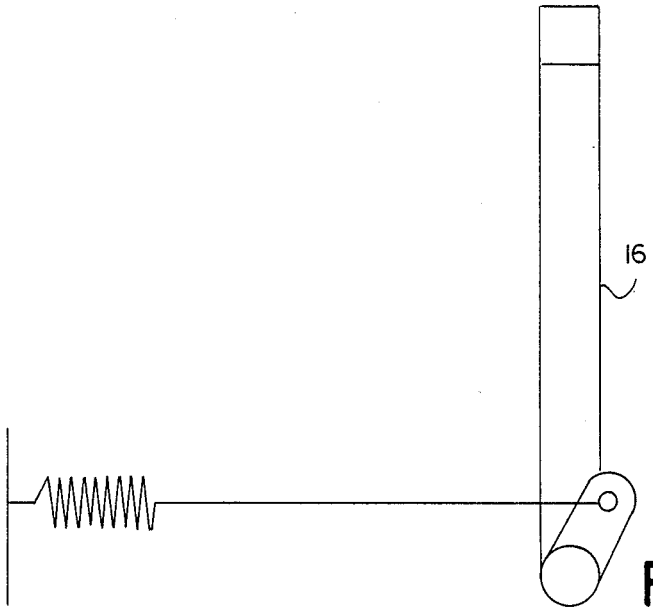

FIG. 29: General layout of a tiltable corner post equipped with an eccentric cam at the swivel hinge connected over a load equalizer with a tension spring.

Figure 30:
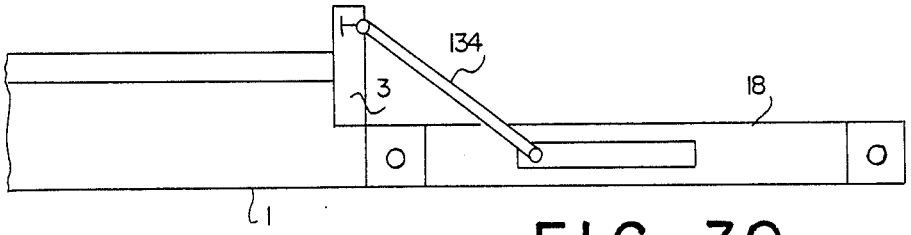

FIG. 30: Lateral view of a tilted corner post with leg-type angle stop.

Figure 31:
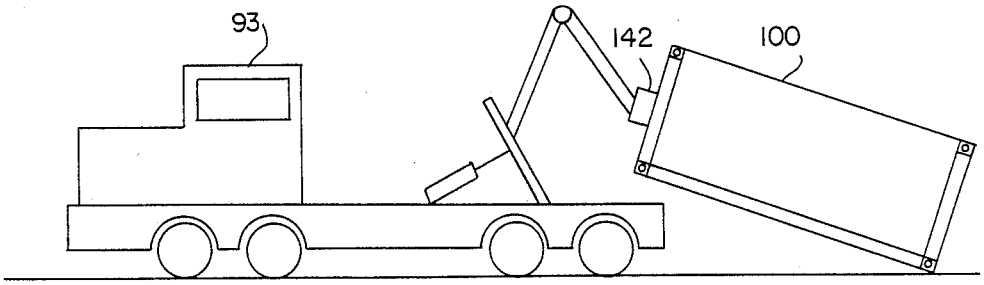
Figure 32:
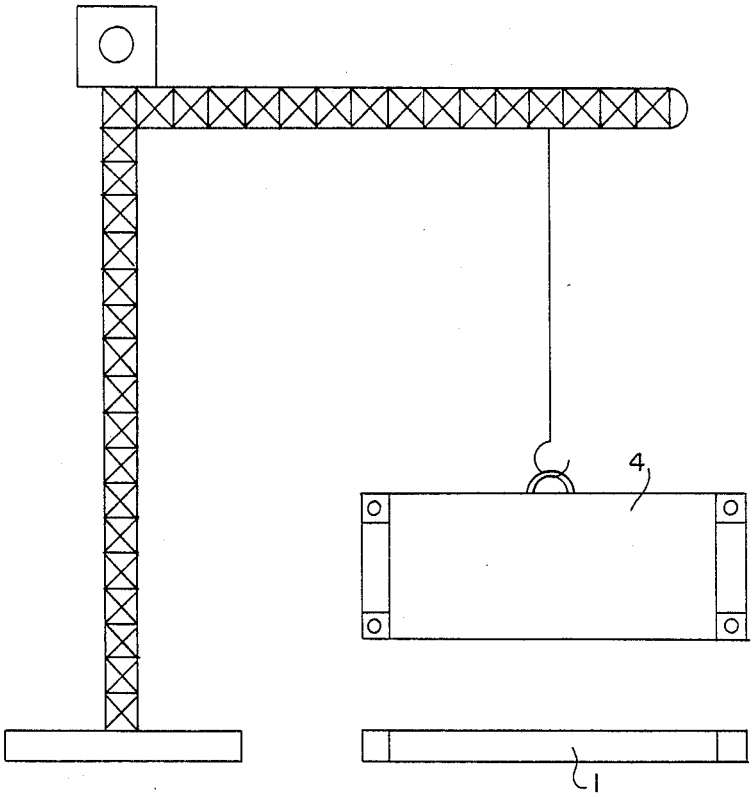

FIG. 31: General layout of a container with loading hitch, to be engaged by the loading device of a truck, and FIG. 32: Lateral view of a container with a hood which can be released from the base plate to be positioned by a crane.

A container consists essentially of a base plate (1), two substantially parallel end walls (2,3) extending vertically to said base plate (1) and a hood (4). Opposite the base plate, hood (4) is limited by a roof (5) which runs approximately plane-parrallel to base plate (1). In the longitudinal direction (92) of base plate (1) there are two side walls (6,7) which are substantially parallel to each other and extend from the roof towards base plate (1). The side walls (6,7) are mounted with their lower edges (8,9) facing base plate (1) sliding on the latter, for example on rollers (10, 11).

In one embodiment according to FIGS. 1 to 3, one of the two end walls (3) is permanently connected with hood (4). The other end wall (2) is permanently connected with base plate (1). Between end wall (2) and the lateral edges (12) which limit hood (4) towards end walls (2), a packing (13) is mounted to provide a moistureproof seal between lateral edges (12) and lateral walls (2). In addition, packings (14, 15) are provided at the lower edges (8,9) of lateral walls (6,7) with the aid of which a moistureproof seal is created between the lateral walls (6,7) and base plate (1).

Corner posts (16, 17, 18, 19) are mounted on said base plate (1). One of said corner posts is mounted in each of the four corners of base plate (1), extending from the latter towards roof (5). A force for lifting the container is introduced into base plate (1) over said corner posts (16, 17, 18, 19). For this purpose, each corner post (16, 17, 18, 19) is equipped with angle fittings (20, 21). The latter are shaped approximately as a hollow square. In their lateral surfaces (22, 23) which are accessible towards the outside, respectively in their top surfaces (24, 25), openings (26, 27) are provided into which a hoisting device for the container (not shown) can be hooked.

The corner posts (16, 17) adjacent to end wall (2) are permanently connected to the latter and base plate (1). On the other hand, the opposite corner posts (18, 19) in a longitudinal direction of the container are mounted tiltable over swivel hinges (28, 29) on base plate (1) at least over part of the area. Said swivel hinges (28, 29) have swivel axes (30,31) extending transversally to the longitudinal direction of the containers, so that corner posts (18,19) extend in a tilted state from end wall (3) in a longitudinal direction of the container. A partially tilted corner post (18, 19) can, for example, be designed as a U-section which in an untilted state receives the tiltable portion.

The tiltable corner posts (18,19) run in their untilted state in the recesses (32, 33), the cross section of which is so adapted to the cross section of corner posts (18,19) that in the untilted state said corner posts (18,19) run with their lateral surfaces at the level of side walls (6,7) and, on the other hand, at the level of end wall (3). This way, the corner recesses (32,33) extend through the lateral edges (36,37) in which the front face (3) meets the lateral walls (6,7). Corner posts (18,19) are equipped with guide tracks (38,39) on the lateral surfaces (34,35) which in their tilted state point upwards, in which e.g. rollers (10,11) can be guided when the hood (4) is displaced on base plate (1) in the direction towards angle fittings (20) of the tilted corner posts (18,19).

The corner posts (18,19) can be swivel-mounted independently from each other with swivel hinges (28.29). However, it is also possible to connect the two tiltable corner posts (18,19) with a cross bracket (40), so that they may be tilted jointly. Said cross bracket (40) is recommended to be sunk in a recess in the end wall (3) when the corner post (18,19) is untilted. It is also possible to rigidly connect the corner fittings (20) in the area of the tiltable corner posts (18, 19) with hood (4) and to provide a locking device in the area of said corner fittings (20) which engage said corner posts (18, 19), stopping them after hood (4), has been lowered.

In addition to the end wall (3), the opposite end wall (2) can also be permanently connected with hood (4). In that case, hood (4) is subdivided into two parts (42,43) which can be connected by a moistureproof packing (85). In order to open the container, one part (42) is displaced towards end wall (3), while the other part (43) is displaced towards the other end wall (2) in relation to base plate (1). In that case, corner posts (16,17) can also be swivel-mounted on base plate (1), so that they can be tilted into a horizontal position before part (43) is moved. On the inside of the lateral surfaces (34,35) of corner posts (16,17), guide tracks (38, 39) are provided similar to those of corner posts (18,19). In addition, part (43) is also connected along its lateral walls (6,7) over a moistureproof packing with base plate (1), and end wall (2) of part (43) is connected over a moistureproof packing to base plate (1). A divided hood (4) can also be used when tiltable end walls (2,3) are provided.

Packings (14,15) by means of which hood (4) is made water-and dustproof against base plate (1), consist preferably of labyrinth seals (71). These consist essentially of interlocking segments.

Rollers (10,11) can be fastened to an eccentric cam (77) which is swivel-mounted to a shaft (78) on base plate (1). By tilting the eccentric cam (77), roller (10) is lifted against the lower edge (8) of side wall (6), so that hood (4) is lifted off base plate (1). Hood (4) can be lifted either manually or automatically.

It is also possible to design the guide tracks (38, 39) in form of a guide rail (79) in which a guide profile (80) is sliding. The guide profile (80) could also be set on rollers (81) in the guide rail (79). The use of a guide profile (80) running in the guide rail (79) is recommended especially in those cases where the hood (4) is subdivided into partial hoods (42,43). In that case, the guide rail (79) and the slide profile (80) act as a telescopic device which reliably prevents the partial hoods from tipping over in case of displacement beyond the limits of base plate (1). In addition, a secure lateral guidance of the partial hoods (42,43) is ensured by the engagement between slide profile (80) and guide rail (79).

The adjustment in height of hood (4) could, for instance, be made manually by means of individual devices. It would also be possible to provide a central linkage coordinating several individual lifting devices (82). Said central linkage could activate the lifting devices (82), e.g. over eccentric cams or inclined planes running at a slant to the horizontal.

Rollers (10,11) can be guided either in the area of recesses (84) or that of tracks (83). If rollers (10,11) are guided within the area of tracks (83), the lateral walls (6,7) slide with their lower edges (8,9) over and beyond the rollers. In that case, rollers must be provided at base plate (1) as well as corner posts (18,19).

On the other hand, rollers (10,11) could also be guided in the recesses (84) at the lower edges (8,9). This type of bearing has the advantage that hood (4) can be guided with relative safety over the swivel hinges (28,29) in the direction of corner posts (18,19). While the guide tracks (38,39) cannot be continued over the swivel hinges (28,29) unto base plate 1, rollers (10,11) guided at the lower edges (8,9) ensure a smooth transit of hood (4) from base plate (1) unto the tilted corner posts (18,19).

The tiltable corner posts (18,19) can also be shaped as levers to lift hood (4) off base plate (1). In this case, the tiltable corner posts (18,19) take a swivel path which, at least in part, is connected with a device for lifting hood (4), e.g. over a linkage. It is also possible to connect it in the first third with a device for unlocking hood (4) from base plate (1). In that case, hood (4) is lifted off base plate (1) only in the second part of the swivel path.

The horizontal swing of the corner posts (18,19) is facilitated by the fact that they are equipped with a load equalizer Said load equalizer can be designed in many ways, e.g. as counterweights, spring equalizer, a power absorbing linkage or a winch. It is also possible to design a hydraulic load equalizer.

Hood (4) can be grasped by a suitable suspension device and lifted off base plate (1). A suitable design of guide rail (79) ensures that the slide profile (80) can be pulled out of an inset opening (91) large enough to correspond to said slide profile (80).

The corner posts are prevented from inadvertedly being tilted by locking them against the end wall (3) with a bolt (86). Said bolt (86) should extend from end wall (3) in a horizontal direction towards corner posts (18, 19). Bolt (86) can be spring-loaded in the direction towards corner posts (18,19). It is recommended that bolts (86) be attached to the upper part of end wall (3) as high as possible towards roof (5). Bolts (86) could also be shaped as hooks which engage apposite openings in corner posts (18,19). In this embodiment of the invention, when hood (4 is lowered), bolts (86) stop corner posts (18,19). After hood (4) has been lifted, bolts (86) release corner posts (18,19) so that they can tilt against base plate 1.

In one embodiment according to FIG. 6, hood (4) is guided at a tiltable end wall (2,3) in a frontal track (99). The frontal track (99) can be structured as separate guide track. But it is also possible to conceive the frontal profile (99), at least in some areas, as part of the labyrinth packing (71) which has legs guiding the lateral walls (6,7). In the area of the frontal profile (99), rollers (10,11) can be mounted to guide side walls (6,7).

The transport box has been designed as container (100). However, it could also be designed as part of a truck (93) or part of a railroad wagon (101). In a container which is part of a truck (93), the base plate (1) is part of the chassis (102) of said truck (93).

Hood (4) is mounted in the range of guide rails (98) which extend at least in part along the driver's cab (97) of truck (93).

In an embodiment of the invention in which the container is part of a truck (93), particular emphasis is given the subdivision of hood (4) into partial hoods (42,43). In this embodiment, the partial hood (42,43) facing the driver's cab (97) is displaced in the direction towards said driver's cab (97). The partial hood (42,43) facing away from the driver's cab (97) can then be displaced at will along base plate (1). It is also possible to design the end wall (2,3) facing away from the driver3 s cab in a tiltable form or to provide tiltable corner posts (18,19) and to permanently connect end wall (2,3) with hood (4). In such a construction it is possible to gain full access to the stowage space from above and from the sides after displacing partial hoods (42,43).

To prevent goods (44) stowed inside the container and along the lateral walls (6,7) from shifting, perpedicular limiters (103) are inserted along the lateral limits of base plate (1). These insertable limiters (103) prevent the goods (44) from shifting, even if they are stowed in contact with lateral walls (6,7).

The partial hoods (42,43) can be connected with each other by longitudinal holding devices (104). The longitudinal holding devices (104) prevent the lateral partial hoods (42,43) from tipping over should they project over end wall (2,3). Besides, said longitudinal holding devices (104) make it possible to adapt the effective subdividion of hood (4) to actual conditions and—as a function of the respective requirements—to connect the partial hoods (42,43) to form a stiff global hood or, after releasing the longitudinal holding devices, to take advantage of the division of the hood into parts (9,10).

In an embodiment of the container according to FIG. 23, the corner posts (16, 17, 18, 19) engage a corner recess (32,33) in the range of which a guide recess (120) is provided to guide corner posts (16, 17, 18, 19). The guide recess (120) spans a plane extending essentially perpendicular, slanted to the longitudinal axis (92) of the container. At corner posts (16, 17, 18, 19), a guide profile (121) is provided which fits into guide recess (120). At the lateral walls (22,23) a guide bar (122) has been mounted to guide corner posts (16, 17, 18, 19). Said guide bar (122) extends practically perpendicular and parallel to the longitudinal axis (92).

To guarantee secure guidance of rollers (10,11), a longitudinal bar (125) has been mounted at base plate (1). To relieve rollers (10,11) in their rest position, an additional relief device (126) has been provided which is conceived essentially as a receiving chamber (128), into which rollers (10,11) are routed over a ramp which can be lowered (127).

The guide rollers (94) mounted vertically below base plate (1) can be guided in a rail (129). Around the corner posts (16, 17, 18, 19), an additional longitudinal guide bar (130) can be provided for the rollers (10,11) to extend essentially in the direction of the longitudinal bar (125) when corner posts (16, 17, 18, 19) are tilted.

The locking device (138) between base plate (1) and hood (4) can be conceived as a central lock (138) equipped with locking pins (139) which are connected over a central linkage (140) to corner posts (16, 17, 18, 19) activating the central locking device (138). However, it would be conceivable to provide manual operation of the central locking device (138). If the central locking device (138) is activated with the aid of corner posts (16, 17, 18, 19), it is recommended to provide activation elements (141) leading into the central linkage (140) and connected to corner posts (16, 17, 18, 19). Said activation elements (141) are connected with the central linkage (140) under end wall (2,3).

In special embodiments it would also be possible to provide a loading hitch (142) at the container to temporarily hitch the latter to a truck loading device.

In the case of a box in form of a container, hood (4) is first unlocked and then lifted during loading and unloading of the inner space (45) with goods (44). Subsequently, the tiltable end walls (2,3), respectively the tiltable corner posts (16, 17, 18, 19) are tilted in relation to base plate (1). Hood (4) or the partial hoods (42,43) can then be suitably displaced and the part of the inner space to be loaded or unloaded becomes accessible by suitable positioning of hood (4). When the loading process is terminated, hood (4) is moved back and the end walls (2,3) or corner posts (16, 17, 18, 19) are tilted back to their rest positions and rollers (10,11) are lowered. When hood (4) has been lowered, the parts of the labyrinth packing (71), provided on one hand at the end walls (2,3) and base plate (1) and on the other at hood (4), securely fit into each other. They thus effectively seal the inner space against dust and moisture and lock the corner posts (18,19) and hood (4) against base plate (1).

We claim:

1. A container comprised of:

a base plate having a longitudinal axis;

two end walls each extending from said base plate, each end wall having a top edge opposite said base plate and two opposing side edges extending from said top edge to said base plate; and a hood extending from and over said base plate and between said two end walls, said hood being movably connected to said base plate so that said hood is longitudinally displaceable along said base plate, said hood being comprised of at least one rigid part, wherein at least one of said end walls is permanently secured to said hood and releasably secured to said base plate, located adjacent to said side edges of said end walls, wherein at least two of said corner posts (16, 17, 18, 19) are connected to said base plate (1) such that they can be tilted with respect to said base plate, said corner posts providing a load transmitting connection with said base plate so that said hood may move longitudinally along said base plate and said tilted corner posts.

2. The container according to claim 1, further comprising swivel joints connecting said at least two corner posts (18, 19) which can be tilted to said base plate (1).

3. The container according to claim 2, wherein said corner posts (16, 17, 18, 19) comprise means which act as a guide for the lower edge (8, 9) of hood (4) when said posts are tilted so that said hood can be moved longitudinally along said base plate and said tilted posts.

4. The container according to claim 3, wherein each tiltable corner post (18, 19) stands in a corner recess (32, 33) of end wall (3) and the cross section of said corner recess (32, 33) corresponds to that of said corner post (18, 19).

5. The container according to claim 4, further comprising a cross bracket (40) connecting said corner posts which can be tilted, said cross bracket being situated opposite the connection between said corner posts and said base plate and wherein hood (4) has a cross section larger than that of one of said end walls permanently connected to said base plate (1), from which the assembly consisting of corner post (18, 19) and cross bracket (40) is tilted away.

6. The container according to claim 5, further comprising rollers (10, 11) and axes located transversly to the longitudinal direction of the lower edge (8, 9) of said hood, said rollers being rotatably mounted on said axes, said axes being mounted at said lower edges (8, 9) of said hood, said rollers (10, 11) being guidable along said base plate and said corner posts (18, 19) when said corner posts are in their tilted positions.

7. The container according to claim 6, further comprising swivel arms wherein rollers (10, 11) are tiltably mounted at the end of said swivel arms, the ends of which run in their tilted position above the tilted corner posts (18, 19).

8. The container according to claim 7, further comprising a load equalizer associated with each of said tiltable corner posts (18, 19).

9. The container according to claim 8, wherein said hood is comprised of two parts, each part (42, 43) of said hood (4) being displacable along said base plate in a direction opposite to the other.

10. The container according to claim 9, further comprising packing located between the two parts (42, 43) of hood (4).

11. The container according to claim 10, further comprising crane loops required for the attachment of hoisting gear being fastened to said hood (4).

12. The container according to claim 11, wherein said means are guide tracks having hollows and wherein said rollers (10, 11) which carry hood (4) during said hood's longitudinal displacement, rest in their locked state in said hollows (83) provided in said guide tracks (38, 39).

13. The container according to claim 12, further comprising a sloping ramp located between hollows (83) and guide track (38, 39), said sloping ramp acting to raise rollers (10, 11) from said hollows.

14. The container according to claim 13, further comprising in the area of base plate (1) at least one guide rail (98) to guide hood (4) said guide rail being designed to extend along at least a part of the length of a truck carrying said container.

15. The container according to claim 12, further comprising a rail (79) located on said lower edge of said hood and on said corner posts which can be tilted such that when hood (4) is moving longitudinally with respect to said base plate it is guided with its rollers (10, 11) on said rail (79).

16. The container according to claim 15, wherein said corner posts (18, 19) are designed as levers to lift the rollers (10, 11) which carry hood (4).

17. The container according to claim 16, further comprising a locking device located at said lower edges (8, 9) of said hood, said corner posts (18, 19) being designed as levers for release of hood (4) from said locking device.

18. The container according to claim 17, further comprising bearings mounted at the lower edge (8, 9) of lateral walls (2, 3) for seating said rollers (10, 11).

19. The container according to claim 18, further comprising at least one bolt provided to lock at least one tiltable corner post (18, 19).

20. The container according to claim 19, wherein at least one of the end walls (2, 3) is swivel-mounted on the base plate (1).

21. The container according to claim 20, wherein said container is designed as part of a truck (93).

22. The container according to claim 21, wherein said rollers (10, 11) are mounted at the corner posts.

23. The container according to claim 22, further comprising a central control, by means of which said rollers can jointly be adjusted.

24. The container according to claim 23, further comprising at least one guide roller (94) mounted below said base plate and extending normal therefrom; and a retaining bar rotatably mounting said roller and connected to said hood such that said guide roller (94) rolls along the underside of said base plate upon longitudinal displacement of said hood.

25. The container according to claim 24, wherein said at least one guide rail (98) for hood (4) is mounted in the area of an operator's cab (97).

26. The container according to claim 24, wherein at least one of said corner posts (16, 17, 18, 19) engages said corner recess (32, 33) in the area of which an angled area of said recess acts as a guide recess (120) to guide corner posts (16, 17, 18, 19).

27. The container according to claim 26, further comprising a relief device (126) at said base plate for receiving at least one of rollers (10, 11) in their rest position.

28. The container according to claim 21, wherein said relief device (126) is designed as a plane which can be sunk into a receiving space (128).

29. The container according to claim 28, wherein in the area of at least one of said corner posts (16, 17, 18, 19) there is a leg-type angle stop (134) limiting the swing of said corner posts (16, 17, 18, 19).

30. The container according to claim 29, further comprising a central locking device (138) mounted in the area of base plate (1) connecting hood (4) to said base plate (1).

31. The container according to claim 30, wherein said hood (4) is so designed that it can be lifted off base plate (1) at least in some areas.

32. The container according to claim 31, further comprising a loading hitch (142) which locks the corner posts (18, 19) and hood (4) against base plate (1).

33. The container according to claim 32, further comprising at least one bolt (86) mounted at the edges of hood (4) facing the tiltable corner posts (16, 17, 18, 19) which bolt connects corner posts (16, 17, 18, 19) with hood (4) when the latter is lowered.

34. A container comprised of:

a base plate having a length and a width and having a longitudinal axis along said length;

two oppositely located end walls, each of said end walls having two opposing side edges, said side edges and said end walls extending generally perpendicularly of said base plate;

a hood slidably attached to said base plate, said hood being pivotally mounted to said base plate such which extend generally perpendicularly of said base plate and a roof extending between said two opposing sides and spaced from said base plate;

and corner posts located adjacent said side edges and forming the corners of the combination of said end walls, and hood, at least two of said corner posts being pivotably mounted to said base plate such that said at least two corner posts may be pivoted away from said end walls and toward said base plate to effectively extend the length of said base plate so that said hood can be displaced longitudinally along said base plate and onto said corner posts, said corner posts providing a load transmitting connection with said base plate.

35. The container of claim 34 wherein at least one of said end walls is permanently connected to said hood and releasably connected to said base plate.

36. The container of claim 34 wherein said end wall which is permanently connected to said hood is sealed by packing against said base plate.

37. A container comprised of:

a base plate having a longitudinal axis;

two end walls, each having a top edge located opposite said base plate and two side edges extending from said top edge to said base plate;

a hood comprised of at least one rigid part and having a roof situated generally opposite of said base plate and two side walls connected to said roof and extending to said base plate, said side walls being movable on said base plate, said hood extending between said two end walls and being displaceable in the direction of said longitudinal axis by movement of said side walls along said base plate, at least one of said end walls being permanently connected to said hood; and corner posts associated with said side edges and providing a load transmitting connection with said base plate.

38. A container comprising:

a base plate having a longitudinal axis;

a rigid hood comprised of a roof situated generally opposite of said base plate and opposing lateral walls connected to said roof and extending to said base plate from said roof, said opposing lateral walls being situated generally parallel to said longitudinal axis and defining lower edges which lower edges are guidable along said base plate, said hood being displacable along the direction of the longitudinal axis of said base plate;

two end walls each having a top edge located near said roof, a bottom edge located opposite said top edge and near said base plate, and sides connecting said top and bottom edges, at least one of said end walls being permanently connected to said hood at said top edge and releasably connected to said base plate at said bottom edge;

a mounting associated with said hood and located longitudinally of said base plate, said mounting providing said hood with a degree of perpendicular freedom with respect to said longitudinal axis;

packing sealably located between said base plate and said at least one end wall permanently connected to said hood; and corner posts associated with said sides of said end walls, said corner posts providing a load transmitting connection to said base plate.

* * * * *